US009102178B2

(12) United States Patent
Kinas et al.

(10) Patent No.: US 9,102,178 B2
(45) Date of Patent: Aug. 11, 2015

(54) MULTI-REGION MEDIA ADVANCE COMPENSATION

(71) Applicant: Hewlett-Packard Development Company, L.P., Houston, TX (US)

(72) Inventors: Erick B. Kinas, Camas, WA (US); Justin M. Roman, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 241 days.

(21) Appl. No.: 13/754,292

(22) Filed: Jan. 30, 2013

(65) Prior Publication Data

US 2014/0210890 A1 Jul. 31, 2014

(51) Int. Cl.

| | |
|---|---|
| ***B41J 2/07*** | (2006.01) |
| ***B41J 11/42*** | (2006.01) |
| ***B41J 2/21*** | (2006.01) |

(52) U.S. Cl.

CPC ..... *B41J 11/42* (2013.01); *B41J 2/2135* (2013.01)

(58) Field of Classification Search

CPC ..... B41J 29/38; B41J 2/07
USPC ..... 347/12, 14
See application file for complete search history.

(56) References Cited

U.S. PATENT DOCUMENTS

| | | | |
|---|---|---|---|
| 6,086,181 | A | 7/2000 | Majette et al. |
| 6,331,038 | B1 | 12/2001 | Boleda et al. |
| 6,619,796 | B2 | 9/2003 | Rasmussen et al. |
| 7,018,034 | B2 | 3/2006 | Rasmussen et al. |
| 7,380,898 | B2 | 6/2008 | Plante et al. |
| 7,391,525 | B2 | 6/2008 | Chapman et al. |
| 7,413,276 | B2 | 8/2008 | Garcia et al. |
| 7,762,642 | B2 | 7/2010 | Fellingham et al. |
| 2002/0063871 | A1 | 5/2002 | Kinas |
| 2010/0309240 | A1 * | 12/2010 | Tomida et al. ..... 347/12 |

OTHER PUBLICATIONS

Media Advance Calibration; MacDermid ColorSpan; TN2726 Revision B; https://dgs.oce.com/PrinterSupport/CS7xxx_Customer/Documentation/TN2726B.pdf.

* cited by examiner

*Primary Examiner* — Alessandro Amari
*Assistant Examiner* — Alexander C Witkowski
(74) *Attorney, Agent, or Firm* — Hewlett-Packard Patent Department

(57) ABSTRACT

In an embodiment, a processor-readable medium stores code representing instructions that when executed by a processor cause the processor to determine a media advance error for each one of multiple page regions on a media page. The instructions further cause the processor to control a media advance mechanism to compensate for the media advance error in each page region.

12 Claims, 6 Drawing Sheets

MULTI-REGION MEDIA ADVANCE COMPENSATION

BACKGROUND

Inkjet printing systems include scanning type systems and single-pass systems. In single-pass printing systems, printheads held on a stationary carriage print images by ejecting ink across the full width of media as the media continually advances underneath the carriage. In scanning type printing systems, a scanning carriage holds one or more printheads and scans the printheads across the width of the media as the media advances underneath the carriage. The media advances in a direction perpendicular to the direction of the scanning carriage. With each scan of the carriage across the media, the printhead(s) prints a single swath of an image, after which the media is advanced in a discrete increment in preparation for the next scan. Errors in the distance the media advances between scans of the carriage can result in print defects known as banding.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
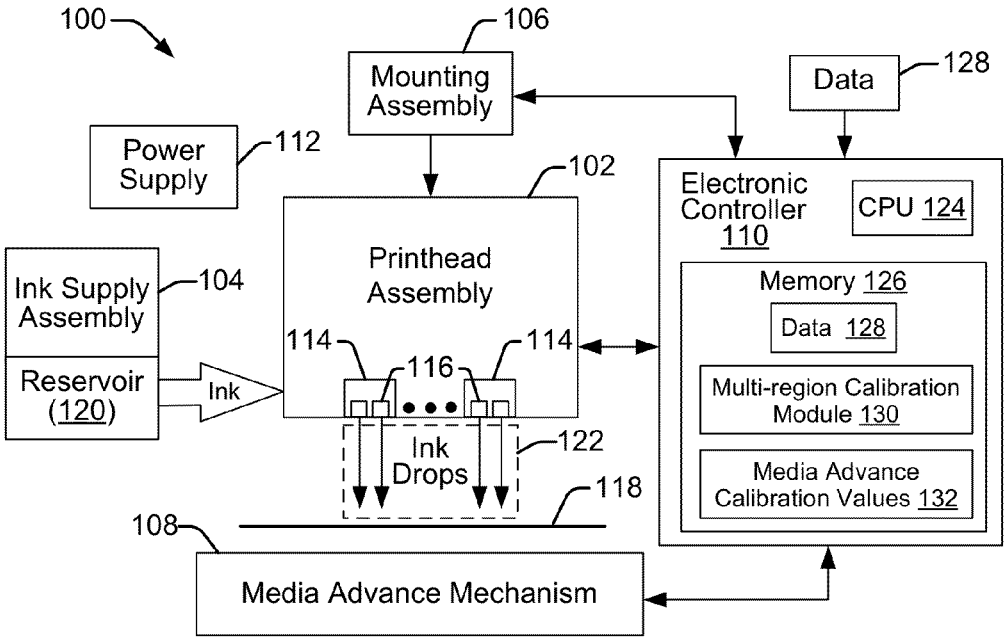
FIG. 1 shows an inkjet printing system suitable for implementing a multi-region media page advance compensation method as disclosed herein, according to an embodiment.

As noted above, media advance errors in scanning inkjet print systems can result in print quality defects referred to as banding. A media advance error that over-feeds a print medium can cause white line banding, while a media advance error that under-feeds a print medium can cause dark line banding. In order to accurately print a continuous image that is free from banding defects, the bottom edge of one printed swath should be exactly aligned with the top edge of the next printed swath. The height of a printed swath is fixed for a given printhead, and when the media advancement exceeds the swath height, white line banding appears on the printed image as gaps between the printed swaths. Alternatively, when the media advancement is less than the swath height, dark line banding appears on the printed image as overlapping swaths that create a "shingle" appearance.

These banding defects can be caused by various features within the print media path of the printer that influence how the media advances through the media path. For example, the pick roller which picks a media page (e.g., a page of paper) from a paper tray, can cause drag against the page as the page moves through the print media path. The drag on the page produces a media advance error. When the trailing edge of the page leaves the pick roller so that it is no longer in contact with the roller, the media advance error changes.

In general, as a media page moves through the print media path of a printer, the media advance error may change several times as the page engages and disengages from different media advance rollers and other features along the media path. Therefore, different regions of the page are printed as the page encounters different levels of media advance error. Stated another way, different levels of media advance error are associated with, or apply to, different regions of the page. Thus, the changing media advance error defines the different regions of the page, and conversely, the transitions between the different page regions are where print media path features are causing changes in the media advance error and where banding defects are likely to change in appearance.

Depending on the length of a media page, some features in the print media path may or may not produce media advance error that can cause banding defects. For example, with shorter media pages, the trailing edge of the page typically clears the pick roller before printing begins near the leading edge of the page. Therefore, the media advance error attributed to the pick roller does not influence a printable region of the page. By the time printing begins on the page, a different media advance error attributable to other features in the print media path (i.e., not attributable to the pick roller) is influencing the page. With longer media pages, however, the trailing edge of the page is usually still engaged by the pick roller when printing begins. Therefore, the media advance error attributed to the pick roller is still influencing the page, and may be causing a banding defect. When the page clears the pick roller, a different page region begins under the influence of a media advance error that has changed based on a reduction in drag resulting from the disengagement of the pick roller.

While shorter media pages may avoid the impact of media advance error caused by certain print media path features, all media pages (i.e., both short and long media pages) experience one or more transitions in media advance error as the pages pass through other features in the print media path, such as a feed roller or intermediate media advance roller. Therefore, one difference between shorter and longer media pages is the number of regions on the page created by changes in the media advance error. Longer media pages typically have one or more additional regions than shorter media pages, due to the increased number of changes in media advance error generally encountered as the pages travel through the print media path.

Efforts to reduce the banding defects caused by print media advance errors in printer media paths are ongoing. Prior methods of addressing such banding defects include calibrating the print media path at the factory during printer manufacture, and calibrating the print media path in-the-field by the user. In-the-field calibration typically involves the printer generating a user-readable plot and the user providing feedback on which pattern is preferred, or the user scanning the plot back into the printer. Such in-the-field calibration can be time consuming for the user and can result in errors based on the user feedback and/or the misplacement of the plot on the printer's scanning mechanism.

Factory calibration of the print media path has a number of disadvantages as well. These include, for example, added costs for space and for calibration operators. In addition, factory calibrations cannot address the impact of aging and wear that occurs over the life of the printer. For example, over time, the wear on a printer affects the amount of friction imparted by the media advance rollers, the accuracy of gear train advancement, and so on. The impact of such wear typically calls for subsequent recalibration of the print media path. Factory calibrations also do not calibrate for more than one media page region. As noted above, there can be several regions on a media page in which the media advance error varies. Another disadvantage in such factory calibration is that it may not be able to account for different media types that a user might place into the printing device.

Another method for addressing banding defects caused by print media advance errors involves printing a pattern of lines on a print medium using two different parts of a printhead. Where lines printed by one part of the printhead line up with lines printed by the other part of the printhead, the print medium is lighter or has higher reflectance. The brightness level at this location is detected by a sensor and used to determine the best alignment. While this method can work well under ideal conditions, printer vibration can impact the print media path direction and cause horizontal lines across a print medium to move up and down. This movement can cause inaccurate measurements of the pattern. Another issue with the use of such patterns is that measurement accuracy is limited due to the number of measurements that can be taken, and by the limitations of the patterns and their interaction with the paper shape.

Embodiments of the present disclosure improve on prior efforts to reduce banding defects caused by print media advance errors, generally through a calibration method that measures the media advance error in multiple regions of the page and adjusts the media advance drive for each region independently to compensate for the media advance error measured in each region. The media advance error in each region is measured using an internally generated diagnostic pattern that is printed on each region of the page. A sensor scans the diagnostic pattern in each region to determine the line feed error (i.e., media advance error) in each region. Under-feed or over-feed values are calculated for each region based on the measured line feed errors. The values are stored in a memory as calibration values for each region. Later, when the printer is printing a page, the calibration values are retrieved and used to adjust the line feed drive being applied to a media advance mechanism in order to compensate the media advance according to which page region is being printed.

Disclosed embodiments of a multi-region calibration method improve on prior single-region calibration methods by providing accurate media advance compensation for each page region individually. Prior single-region methods calibrate one page region and then assume nominal offsets for other page regions. However, significant variation in calibration values is known to exist between different page regions, and the use of a single value ensures that print quality will suffer in a given population of units.

In one example embodiment, a processor-readable medium stores code representing instructions that when executed by a processor cause the processor to determine a media advance error for each one of multiple page regions on a media page. The instructions further cause the processor to control a media advance mechanism to compensate for the media advance error within each page region.

In another example embodiment, a processor-readable medium stores code representing instructions that when executed by a processor cause the processor to print a diagnostic pattern on a media page within multiple page regions. The instructions further cause the processor to scan the diagnostic pattern in each page region, and to determine a media advance error for each page region based on the scanning. The instructions further cause the processor to control a media advance mechanism to compensate for the media advance error within each page region.

In another example embodiment, a processor-readable medium stores code representing instructions that when executed by a processor cause the processor to print a first pattern of first elements into multiple page regions of a first media page using bottom-most nozzles of a printhead, advance the first media page, and print a second pattern of second elements into the multiple page regions using top-most nozzles of the printhead, where the second elements are interleaved among the first elements. The instructions further cause the processor to determine a media advance error for each page region from a difference in relative positions of the first and second patterns, and store a calibration value calculated for each media advance error into a memory. Prior to printing a subsequent media page, the instructions direct the processor to retrieve the calibration values, and, while printing the subsequent media page, to drive a media advance mechanism using the calibration values so as to compensate for the media advance error in each page region.

Illustrative Embodiments

FIG. 1 illustrates an inkjet printing system 100 suitable for implementing a multi-region media page advance compensation method as disclosed herein, according to an embodiment of the disclosure. In this embodiment, a fluid ejection assembly is disclosed as a fluid drop jetting printhead 114. Inkjet printing system 100 includes an inkjet printhead assembly 102, an ink supply assembly 104, a mounting assembly 106, a media advance mechanism 108, an electronic printer controller 110, and at least one power supply 112 that provides power to the various electrical components of inkjet printing system 100. Inkjet printhead assembly 102 includes at least one fluid ejection assembly 114 (printhead 114) having a printhead die that ejects drops of ink through a plurality of orifices or nozzles 116 toward a media page 118 so as to print onto the media page 118. A media page 118 can be any type of suitable print medium sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon a media page 118 as inkjet printhead assembly 102 and the media page 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In this case, reservoir 120 includes a local reservoir located within the cartridge, but may also include a larger reservoir located separately from the cartridge to refill the local reservoir through an interface connection, such as a supply tube. In another embodiment, ink supply assembly 104 is separate from inkjet printhead assembly 102 and supplies ink to inkjet printhead assembly 102 through an interface connection. In either embodiment, reservoir 120 of ink supply assembly 104 may be removed, replaced, and/or refilled.

Figure 2:
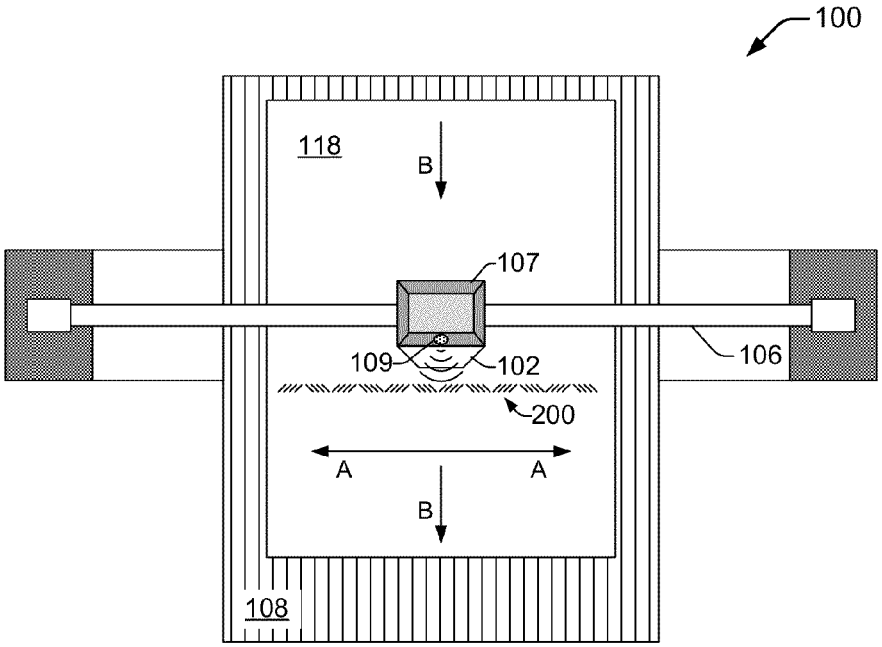
FIG. 2 shows an example of a scanning type inkjet printing system, according to an embodiment.

Mounting assembly 106 positions inkjet printhead assembly 102 relative to media advance mechanism 108, and media advance mechanism 108 positions media page 118 relative to inkjet printhead assembly 102. Thus, a print zone 122 is defined adjacent to nozzles 116 in an area between inkjet printhead assembly 102 and media page 118. In one embodiment, inkjet printing system 100 is a scanning type printer where inkjet printhead assembly 102 is a scanning printhead assembly. FIG. 2 illustrates an example of a scanning type inkjet printing system 100, according to an embodiment of the disclosure. In a scanning type inkjet printing system 100, mounting assembly 106 includes a carriage 107 that moves inkjet printhead assembly 102 in a generally horizontal manner which is orthogonal relative to a media page 118 being advanced by media advance mechanism 108. The carriage 107 scans printhead assembly 102 with printhead(s) 114 back and forth across the width of media page 118 in forward and reverse passes, as indicated in FIG. 2 by the horizontal arrows labeled A. Thus, media advance mechanism 108 positions media page 118 relative to inkjet printhead assembly 102 by moving the media page 118 along a print media path that is orthogonal to the horizontal movement of the printhead assembly 102, as indicated by the vertical arrows labeled B.

Media advance mechanism 108 can include various mechanisms (not shown in FIGS. 1 and 2) that assist in advancing a media page 118 through a media path of printing system 100. These can include, for example, various media advance rollers (discussed in more detail below with regard to FIG. 3), and a motor, such as a DC servo motor or a stepper motor to power the media advance rollers. In some implementations, a media advance mechanism 108 might include other or additional mechanisms to advance a media page 118, such as a moving platform.

In addition to carriage 107, mounting assembly 106 also includes a sensor 109 fixed to the carriage 107. Sensor 109 is a lightness sensor that scans a diagnostic pattern 200 printed on a media page 118 and measures reflectance from the media page 118, as discussed below. Sensor 109 generally comprises a device and associated electronics that transmit, direct, refract and/or reflect light or other electromagnetic energy toward printing composition (i.e., a printed diagnostic pattern 200) on a media page 118 to detect the quantity or amount of light or other electromagnetic energy reflected from or absorbed by the printing composition on the media page 118.

Referring again to FIG. 1, electronic controller 110 includes a processor (CPU) 124, a memory 126, firmware, and other printer electronics for communicating with and controlling inkjet printhead assembly 102, mounting assembly 106, and media advance mechanism 108. Memory 126 can include both volatile (i.e., RAM) and nonvolatile (e.g., ROM, hard disk, floppy disk, CD-ROM, etc.) memory components comprising computer/processor-readable media that provide for the storage of computer/processor-readable coded instructions, data structures, program modules, and other data for printing system 100. Electronic controller 110 receives data 128 from a host system, such as a computer, and stores the data 128 in memory 126. Typically, data 128 is sent to inkjet printing system 100 along an electronic, infrared, optical, or other information transfer path. Data 128 represents, for example, a document or image file to be printed. As such, data 128 forms a print job for inkjet printing system 100 that includes one or more print job commands and/or command parameters. Using data 128, electronic controller 110 controls inkjet printhead assembly 102 to eject ink drops from nozzles 116. Thus, electronic controller 110 defines a pattern of ejected ink drops that form characters, symbols, and/or other graphics or images on media page 118. The pattern of ejected ink drops is determined by the print job commands and/or command parameters from data 128.

In one embodiment, electronic controller 110 includes a multi-region calibration instruction module 130 and media advance calibration values 132 (discussed below) stored in memory 126. Multi-region calibration module 130 comprises instructions executable on processor 124 to control components of printing system 100 in calibrating the media advance mechanism 108. Media advance mechanism 108 is calibrated to compensate for media advance error measured within each of multiple page regions on a media page 118, as discussed below. As noted above, various features within the print media path of a printer influence how a media page 118 advances through the media path. Such features include, significantly, the media advance rollers that advance the media pages 118 through the printer along a media path.

Figure 3:
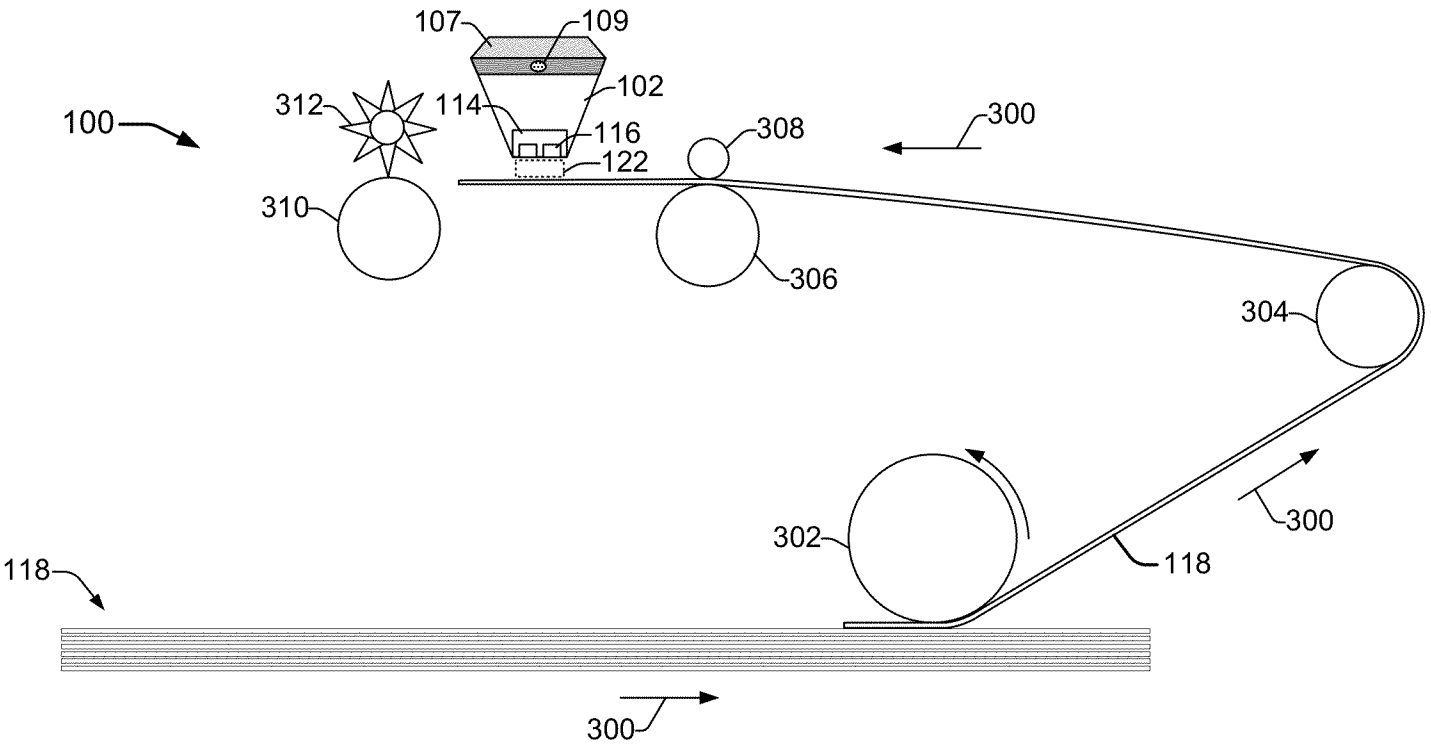
FIG. 3 shows a side view of an example printing system 100 that illustrates one example configuration of media advance rollers, according to an embodiment.

FIG. 3 shows a side view of an example printing system 100 that illustrates one example configuration of media advance rollers, according to an embodiment of the disclosure. While FIG. 3 illustrates a sheet-fed printer configuration that uses pre-cut paper of different sizes, the concepts disclosed herein apply analogously to roll-fed printer configurations that image paper on a continuous roll. In roll-fed printers, individual sheets are created at the end of the roll-fed process after the paper is imaged. In a roll-fed printer, there will be fewer page regions 400 (see FIG. 4), because the paper is cut after imaging, so there is no real trailing edge of the paper. However, there can be page regions due to the leading paper edge as it enters the output system. Furthermore, while FIG. 3 illustrates a particular number of media advance rollers that are referenced in a particular manner and configured in a particular way, it is noted that other printers and printing systems may have various other roller configurations having a greater or fewer number of rollers positioned in different locations and referenced in different ways. It should be understood that the concepts conveyed and encompassed by the embodiments disclosed herein are equally applicable to printers and printing systems with such varying media advance roller configurations.

Referring to FIG. 3, a variety of media advance rollers are used to advance media pages 118 through printing system 100, along a media path generally indicated by arrows 300. In this example, a pick roller 302 takes the media page 118 from the top of a stack of media pages and moves it along the media path 300. A turn roller 304, or intermediate roller 304, advances the media page 118 around a curved path such that the page 118 continues to advance along media path 300. The media page 118 is then further advanced through the print zone 122 by the feed roller 306 and idler roller 308. A discharge roller 310 and star wheel 312 then advance the media page 118 further along the media path 300 as it exits the printer 100.

Figure 4:
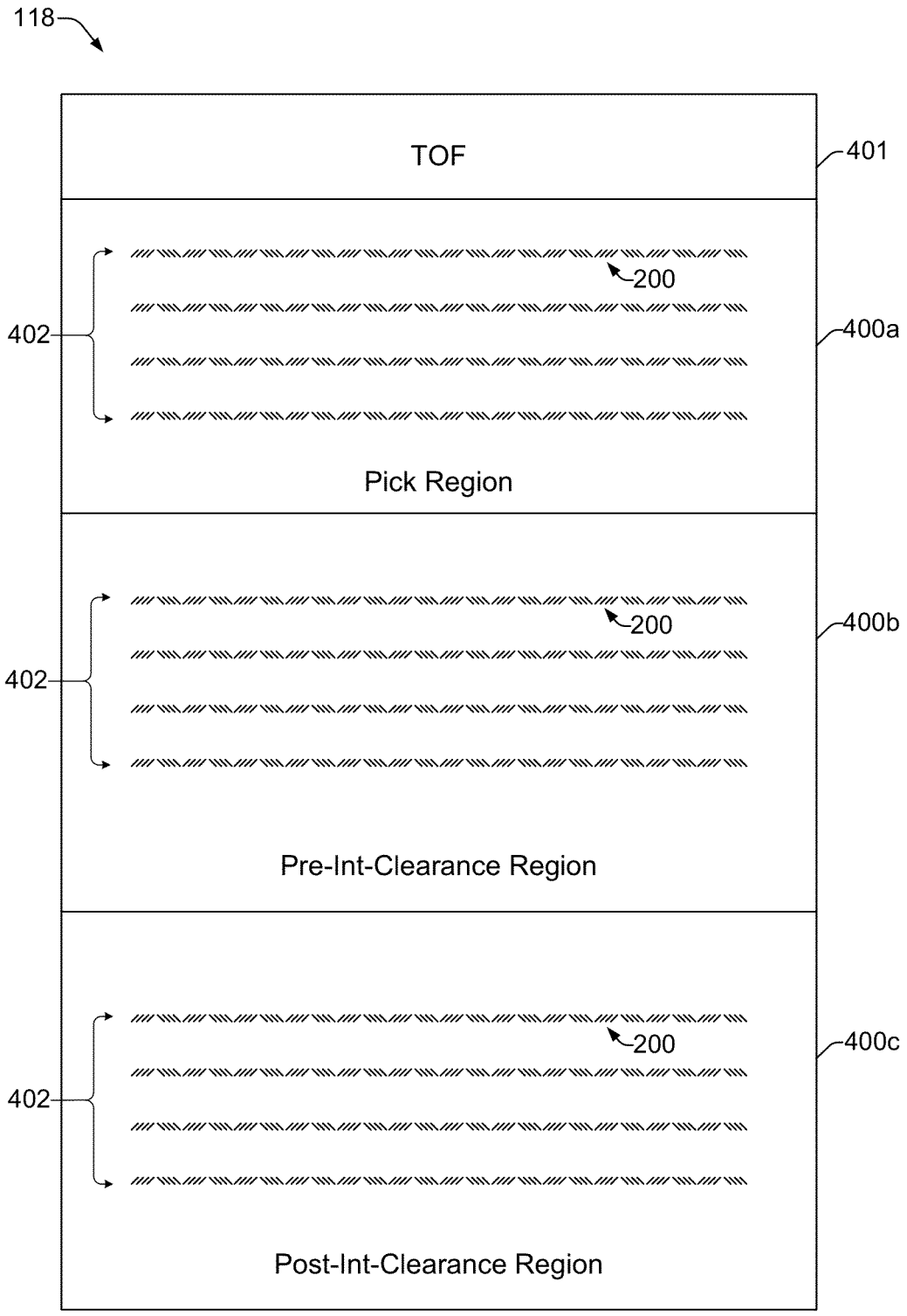
FIG. 4 shows an example of a media page with a number of different page regions whose boundaries are defined by different media advance rollers engaging and disengaging the media page as the page advances along a media path, according to an embodiment.

As noted above, each of the media advance rollers applies a media advance error to the media page 118 while it is engaged with the page. As soon as the media page 118 clears a media advance roller, the page is no longer influenced by that roller, and the media advance error changes. With each such change in media advance error, the boundary of a page region is defined on a media page 118. FIG. 4 shows an example of a media page 118, according to an embodiment, that illustrates a number of different page regions 400 whose boundaries are defined by the different media advance rollers engaging and disengaging the media page 118 as the page advances along a media path, such as media path 300 in FIG. 3. The first region at the top of the media page 118 is referred to as the top of form (TOF) 401. In this example, the TOF 401 section is a page region on which there will be no printing.

The pick region 400*a*, is a page region in which the media page 118 is engaged by (i.e., in contact with) the pick roller 302 and the intermediate roller 304. In the pick region 400*a*, where the media page 118 is a larger size, the page 118 may also be engaged by other media rollers further along in the media path 300, such as the feed roller 306 and idler roller 308, and possibly the discharge roller 310 and star wheel 312. A first media advance error is associated with the pick region 400*a*, which includes the influence or drag against the page from both the pick roller 302 and the intermediate roller 304, and possibly other media rollers. The pre-int-clearance region 400*b* begins when the trailing edge of the media page 118 clears the pick roller 302. Therefore, the pre-int-clearance region 400*b* is the page region in which the media page 118 is engaged by the intermediate roller 304, but not the pick roller 302. In the pre-int-clearance region 400*b*, the media page 118 may also be engaged by the feed roller 306 and idler roller 308, and possibly the discharge roller 310 and star wheel 312. Therefore, a second media advance error is associated with the pre-int-clearance region 400*b*, which includes the influence or drag against the page from the intermediate roller 304 and possibly the feed roller 306 and idler roller 308. The post-int-clearance region 400*c* begins when the trailing edge of the media page 118 clears the intermediate roller 304. Therefore, the post-int-clearance region 400*c* is the page region in which the media page 118 is engaged by the feed roller 306 and idler roller 308, but not by the intermediate roller 304. In the post-int-clearance region 400*c*, the page 118 may also be engaged by the discharge roller 310 and star wheel 312. Therefore, a third media advance error is associated with the post-int-clearance region 400*c* which includes the influence or drag against the page from the feed roller 306 and idler roller 308, and possibly the discharge roller 310 and star wheel 312.

Referring to FIG. 4, and again to electronic controller 110 in FIG. 1, the multi-region calibration module 130 executes on processor 124 to calibrate the media advance mechanism 108 such that the media advance error in each of the page regions 400 is compensated. Calibrating the media advance mechanism 108 to compensate media advance error in each of the page regions 400 begins with measuring the media advance error in each page region. To measure the media advance error in each page region, the processor 124, executing instructions from calibration module 130, controls inkjet printhead assembly 102 and printhead 114 to print a number of lines 404 of a diagnostic pattern 200 into each page region.

Figure 5:
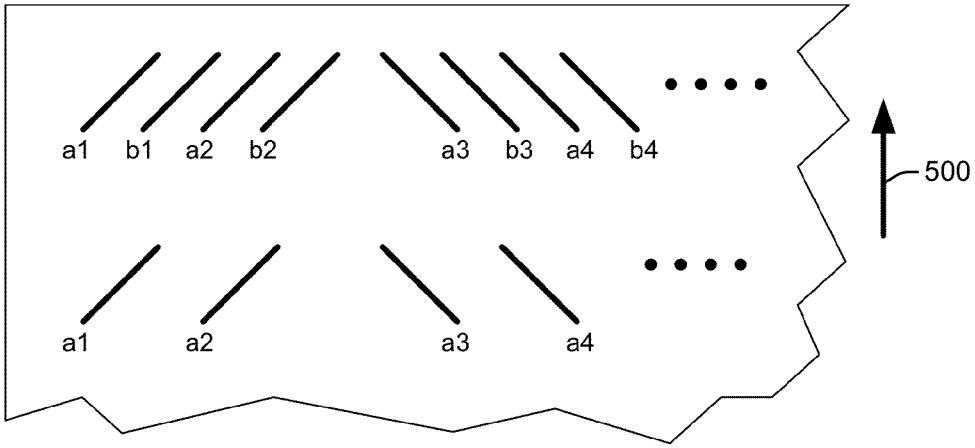
FIG. 5 shows a magnified version of a diagnostic pattern, according to an embodiment.
Figure 6:
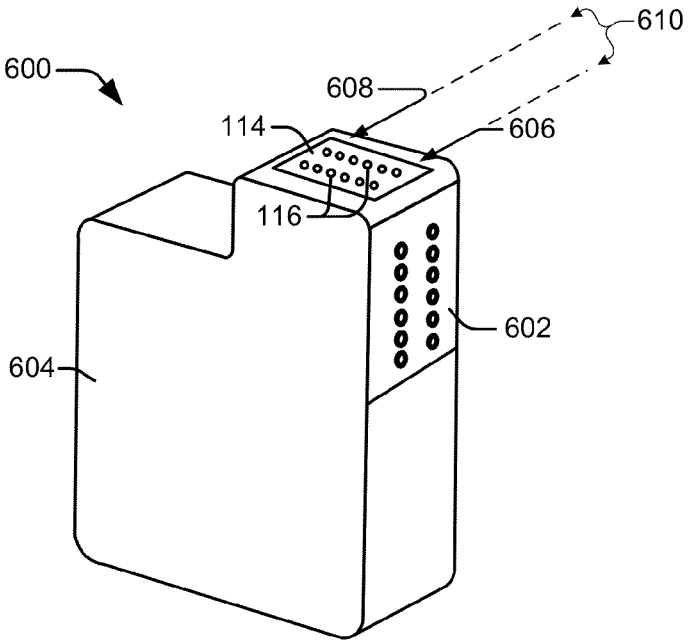
FIG. 6 shows a perspective view of an example inkjet cartridge (or pen) that includes an inkjet printhead assembly and ink supply assembly, according to an embodiment.

FIG. 5 shows a magnified version of the diagnostic pattern 200, according to an embodiment. FIG. 6 shows a perspective view of an example inkjet cartridge 600 (or pen 600) that includes inkjet printhead assembly 102 and ink supply assembly 104 (FIG. 1), according to an embodiment of the disclosure. In addition to one or more printhead dies 114, inkjet cartridge 600 includes electrical contacts 602 and an ink (or other fluid) supply chamber 604. As shown in FIG. 5, printing the diagnostic pattern 200 includes printing a first pattern of first elements a1, a2, a3, and a4, advancing the media page 118 in the direction indicated by arrow 500, and then printing a second pattern of second elements b1, b2, b3, and b4, where the second elements are interleaved among the first elements. The first pattern of first elements a1, a2, a3, and a4, is printed with the bottom most 606 nozzles 116 on printhead 114, or, those nozzles 116 located closest to the bottom end of the printhead 114 and cartridge 600, as shown in FIG. 6. The second pattern of second elements b1, b2, b3, and b4, is printed with the top most 608 nozzles 116 on printhead 114, or, those nozzles 116 located closest to the top end of the printhead 114 and cartridge 600. The distance 610 between the bottom 606 nozzles and top 608 nozzles on the printhead 114 acts as a ruler that defines the height of a print swath. Thus, but for the presence of media advance error, the advancement of the media page 118 between printing the first elements and the second elements should precisely align the first elements with the second elements. However, as discussed below, a difference in alignment between the first elements and the second elements is what determines the amount of media advance error.

As each line 402 of the diagnostic pattern 200 is printed, the sensor 109 scans the diagnostic pattern 200 and measures reflectance from the diagnostic pattern 200 printed on media page 118. Based on the amount of light or energy detected by the sensor 109, the processor 124 compares the first pattern of first elements with the second pattern of second elements, and determines the media advance error based on the difference in relative positions of the first and second patterns. The processor 124 makes this determination by calculating a best fit center of area (i.e., a "centroid") of the signal response from the sensor 109 for both the first elements a1, a2, a3, and a4, and the second elements b1, b2, b3, and b4. Using the centroids calculated from the first elements and the second elements, the processor 124 determines a print media advance error. In this manner, the media advance error for each page region 400 is determined. Additional details regarding the specific techniques used in determining the centroids and the print media advance error can be found in patent application, U.S. Ser. No. 13/688,551, of Erick Blane Kinas, filed Nov. 29, 2012, and titled "Calibration Apparatus", the content of which is incorporated herein by reference in its entirety.

While the media advance error can be determined based on a single line 402 of the diagnostic pattern 200, in other implementations the media advance error for a page region 400 is determined based on all of the lines 402 of the diagnostic pattern 200 within that page region. This is achieved by determining a media advance error for each line 402 within a page region 400, as discussed above. The media advance errors determined for each individual line 402 within the page region 400 are then averaged to determine an average media advance error for the page region 400.

The media advance error for each page region 400 is then used to calculate a media advance calibration value 132. The calibration values 132 are stored in a memory 126 (FIG. 1), as noted above. The calibration values 132 are the values used to drive, or control, the media advance mechanism 108 enabling it to compensate for the media advance error measured in each page region. Thus, once the calibration values 132 have been calculated and stored in memory for each page region 400, when a subsequent media page 118 is printed, the calibration values 132 are retrieved from memory and used to drive the media advance mechanism 108. A calibration value 132 associated with a given page region 400 drives the media advance mechanism 108 at a rate uniquely suited to compensate for the media advance error previously measured for that page region 400.

Figure 7:
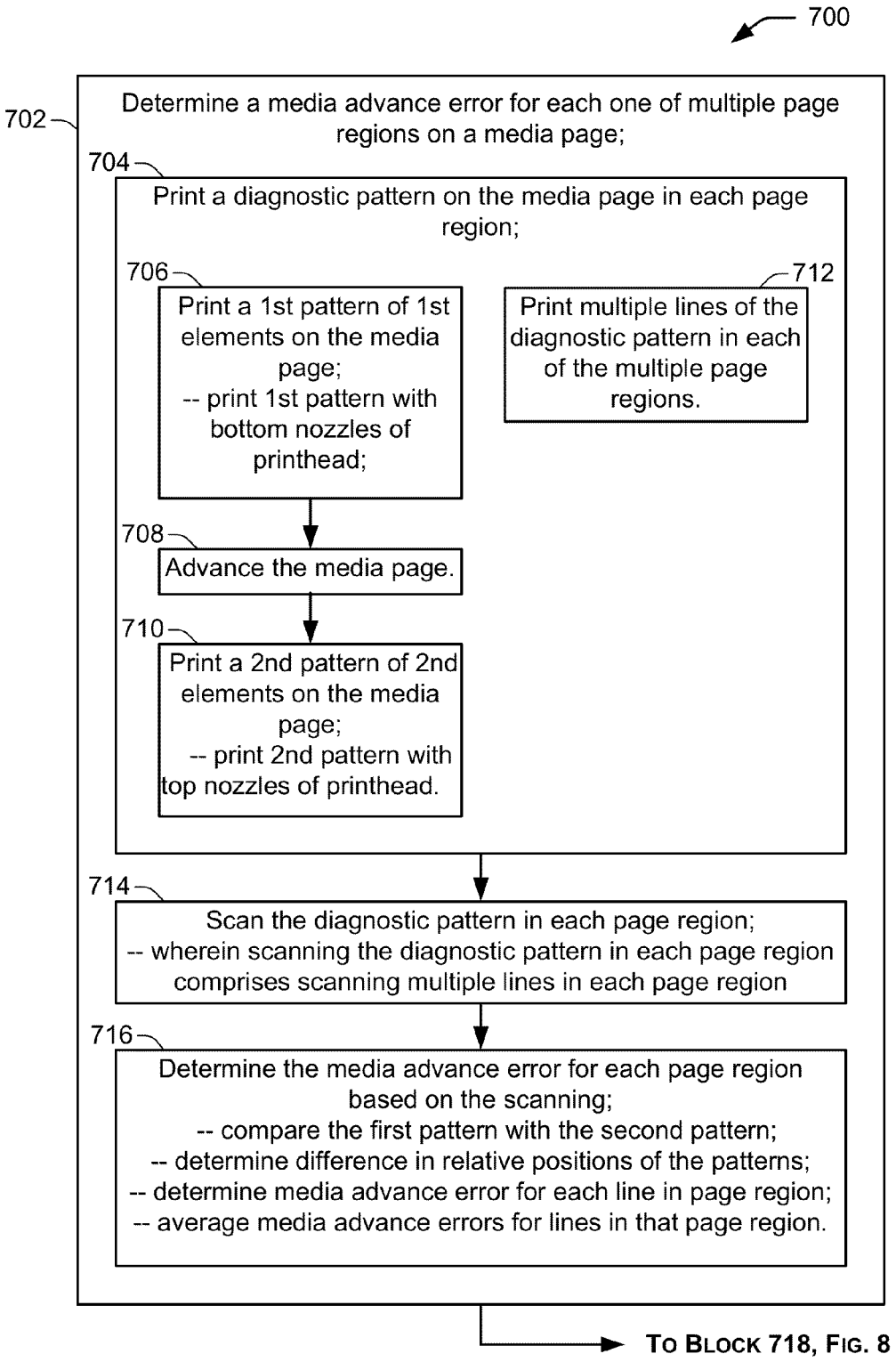
FIGS. 7 and 8 show flowcharts of an example method related to multi-region media page advance compensation, according to embodiments.
Figure 8:
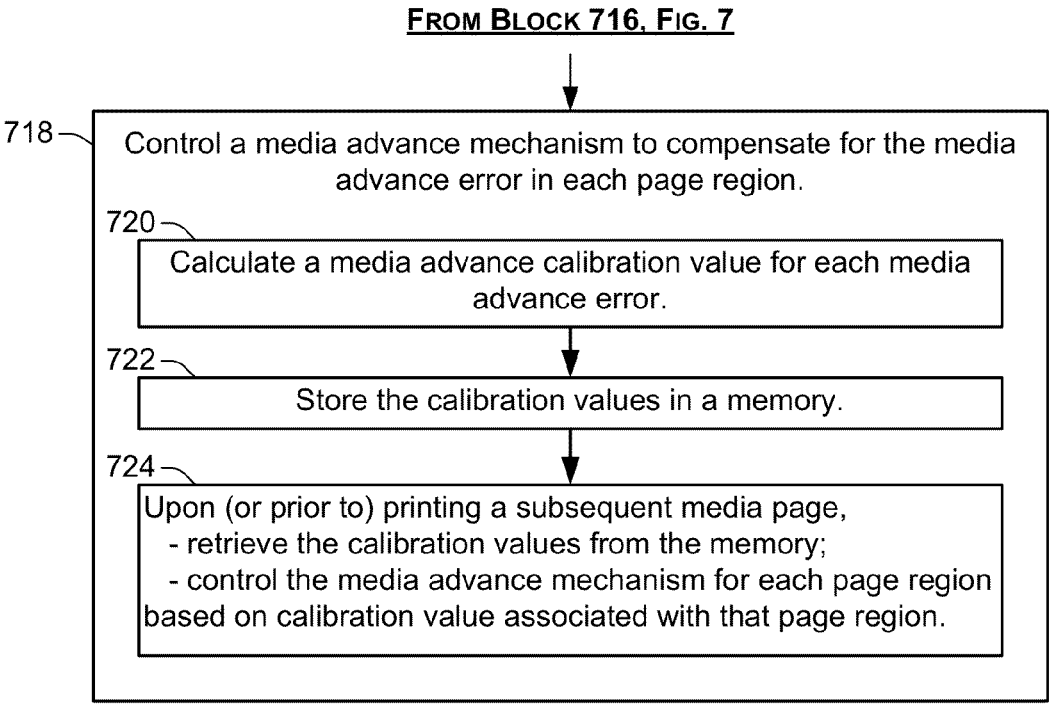

FIGS. 7 and 8, show flowcharts of an example method 700, related to multi-region media page advance compensation, according to embodiments of the disclosure. Method 700 is associated with the embodiments discussed above with regard to FIGS. 1-6, and details of the steps shown in method 700 can be found in the related discussion of such embodiments. The steps of method 700 may be embodied as programming instructions stored on a computer/processor-readable medium, such as memory 126 of FIG. 1. In an embodiment, the implementation of the steps of method 700 is achieved by the reading and execution of such programming instructions by a processor, such as processor 124 of FIG. 1. Method 700 may include more than one implementation, and different implementations of method 700 may not employ every step presented in the flowcharts. Therefore, while steps of method 700 are presented in a particular order within the flowcharts, the order of their presentation is not intended to be a limitation as to the order in which the steps may actually be implemented, or as to whether all of the steps may be implemented. For example, one implementation of method 700 might be achieved through the performance of a number of initial steps, without performing one or more subsequent steps, while another implementation of method 700 might be achieved through the performance of all of the steps.

Method 700 of FIG. 7, begins at block 702, where the first step shown is to determine a media advance error for each one of multiple page regions on a media page. As shown at block 704, determining a media advance error can include printing a diagnostic pattern on the media page in each page region. Printing a diagnostic pattern on the media page can include printing a first pattern of first elements on the media page with bottom nozzles of printhead, advancing the media page, and printing a second pattern of second elements on the media page with the top nozzles of the printhead, as shown at blocks 706, 708, and 710, respectively. Printing a diagnostic pattern on the media page can also include printing multiple lines of the diagnostic pattern into each of the multiple page regions, as shown at block 712.

Determining a media advance error can also include scanning the diagnostic pattern in each page region, as shown at block 714. As noted above, a sensor scans each line of the diagnostic pattern as it is printed, and measures reflectance from the pattern. Where printing the diagnostic pattern includes printing multiple lines of the diagnostic pattern into each page region, scanning the diagnostic pattern in each page region comprises scanning multiple lines in each page region. As shown at block 716, determining a media advance error can also include determining the media advance error for each page region based on the scanning, which can include comparing the first pattern with the second pattern, and determining a difference in relative positions of the patterns. Determining the media advance error for each page region based on the scanning can also include determining a media advance error for each line within a page region, and averaging the media advance errors for all the lines in that page region.

Method 700 continues on FIG. 8, at block 718, with controlling a media advance mechanism to compensate for the media advance error in each page region. Controlling a media advance mechanism can include calculating a media advance calibration value for each media advance error and storing the calibration values in a memory, as shown at blocks 720 and 722, respectively. As shown at block 724, controlling a media advance mechanism can further include, upon printing a subsequent media page (or prior to printing a subsequent media page), retrieving the calibration values from the memory, and controlling the media advance mechanism for each page region based on the calibration value associated with that page region.

What is claimed is:

1. A non-transitory processor-readable medium storing code representing instructions that when executed by a processor cause the processor to:

in each page region of multiple page regions on a media page, print multiple lines of a diagnostic pattern;

scan the diagnostic pattern in each page region;

for each of the page regions, determine a media advance error for each line of the multiple lines in the page region;

for each of the page regions, average the media advance errors for the lines in the page region; and for each of the page regions, control a media advance mechanism to compensate for the averaged media advance error in the page region.

2. The non-transitory processor-readable medium as in claim 1, wherein to print the multiple lines of a diagnostic pattern, the instructions are further to cause the processor to:

print a first pattern of first elements on the media page;

advance the media page; and print a second pattern of second elements on the media page.

3. The non-transitory processor-readable medium as in claim 2, wherein the instructions are further to cause the processor to:

print the first pattern with bottom nozzles of a printhead; and print the second pattern with top nozzles of the printhead.

4. The non-transitory processor-readable medium as in claim 2, wherein to determine the media advance error the instructions are further to cause the processor to:

compare the first pattern with the second pattern; and determine a difference in relative positions of the patterns.

5. The non-transitory processor-readable medium as in claim 1, wherein to scan the diagnostic pattern in each page region the instructions are further to cause the processor to scan the multiple lines in each page region.

6. The non-transitory processor-readable medium as in claim 1, wherein the instructions are further to cause the processor to:

calculate a media advance calibration value for each media advance error; and store the calibration values in a memory.

7. The non-transitory processor-readable medium as in claim 6, wherein the instructions are further to cause the processor to:

upon printing a subsequent media page, retrieve the calibration values from the memory; and control the media advance mechanism for each page region based on a calibration value associated with that page region.

8. A method for multi-region media advance error compensation, said method comprising:

in each page region of multiple page regions on a media page, printing multiple lines of a diagnostic pattern;

scanning the multiple lines of the diagnostic pattern in each page region;

for each of the page regions, determining a media advance error for each line of the multiple lines in the page region based on the scanning;

for each of the page regions, calculating an average of the media advance errors for the lines within the page region; and for each of the page regions, control a media advance mechanism to compensate for the determined media advance error within the page region.

9. The method as in claim 8, wherein printing multiple lines of a diagnostic pattern comprises:

printing a first pattern of first elements on the media page using bottom-most nozzles of a printhead;

advancing the media page; and printing a second pattern of second elements on the media page using top-most nozzles of the printhead, wherein the second elements are interleaved among the first elements.

10. The method as in claim 8, further comprising:

calculating a media advance calibration value for each media advance error;

storing the calibration values in a memory;

retrieving the calibration values from the memory prior to printing a subsequent media page; and controlling the media advance mechanism to compensate for the media advance error within each page region based on a calibration value associated with that page region.

11. A printer comprising:

a processor;

a memory on which is stored instructions that when executed by the processor cause the processor to:

in each page region of multiple page regions on a media page, print multiple lines of a first pattern of first elements using bottom-most nozzles of a printhead;

advance the media page;

in each of the multiple page regions, print multiple lines of a second pattern of second elements using top-most nozzles of the printhead, wherein the second elements are interleaved among the first elements;

scan the first elements and the second elements in each of the multiple page regions;

for each of the multiple page regions, determine a media advance error for each line of the multiple lines of the first elements and the second elements;

for each of the multiple page regions, calculate an average of the media advance errors for the lines within respective page regions; and for each of the multiple page regions, calculate a calibration value for each media advance error.

12. The printer as in claim 11, wherein the instructions are further to cause the processor to:

store the calculated calibration values into a memory;

prior to printing a subsequent media page, retrieve the calibration values; and while printing the subsequent media page, drive a media advance mechanism using the calibration values to compensate for the media advance error in each page region.

* * * * *